US005938426A

United States Patent [19]

McGehee

[11] Patent Number: 5,938,426

[45] Date of Patent: Aug. 17, 1999

[54] PILOTLESS FLARE IGNITOR

[76] Inventor: Van C. McGehee, 30 Clark Dirt Pit Rd., Laurel, Miss. 39440

[21] Appl. No.: 08/926,616

[22] Filed: Sep. 10, 1997

[51] Int. Cl.[6] ..... F23Q 3/00; F23D 21/00

[52] U.S. Cl. ..... 431/202; 431/263; 431/264

[58] Field of Search ..... 431/202, 263, 431/258, 259, 264, 265; 60/39.827

[56] References Cited

U.S. PATENT DOCUMENTS

| | | | |
|---|---|---|---|
| 2,776,394 | 1/1957 | Cuny et al. | 431/263 |
| 2,777,512 | 1/1957 | Johnson et al. | 431/263 |
| 3,207,953 | 9/1965 | Smith et al. | 431/263 |
| 3,506,386 | 4/1970 | Goto | 431/255 |
| 3,536,428 | 10/1970 | Beesch | 431/264 |
| 3,718,425 | 2/1973 | Weyl et al. | 431/263 |
| 4,121,419 | 10/1978 | Kaznetsov et al. | 431/263 |
| 4,215,979 | 8/1980 | Morishita | 431/264 |
| 4,431,402 | 2/1984 | Hamilton | 431/23 |
| 5,062,791 | 11/1991 | Liou | 431/266 |
| 5,160,256 | 11/1992 | Riehl | 431/266 |
| 5,462,431 | 10/1995 | Ahmady | 431/43 |

FOREIGN PATENT DOCUMENTS

| | | | |
|---|---|---|---|
| 430043 | 10/1945 | France | 431/263 |

OTHER PUBLICATIONS

Data Sheet, Flare Industries, Inc. P. 300, Model 100 Ignitor Brochure, "The Stackmatch", "Hot Rod" vent flare ignitor, Stackmatch Flare Ignition Corp.

*Primary Examiner*—Carl D. Price
*Attorney, Agent, or Firm*—John M Harrison

[57] ABSTRACT

A pilotless flare ignitor for igniting waste gas issuing from a flare stack, characterized by an ignitor housing including a horizontal ignitor head having an open end which extends into the flare stack. A pair of electrodes are mounted horizontally in the ignitor head and the ends of the electrodes are positioned to define a diagonal spark gap for producing a spark in the ignitor head. A step-up transformer is wired to the electrodes for generating the spark in the spark gap and a timer, wired to the transformer, controls the duration of the spark. As the gas flows upwardly through the flare stack and into the open end of the ignitor head, the timer is operated to periodically energize the transformer and produce a spark between the electrodes in order to intermittently ignite the waste gas in the ignitor head and flare stack. When the timer de-energizes the transformer and the spark is extinguished, the flaming gas is cleared from the ignitor head and confined to the portion of the flare stack which extends above the ignitor head, thus minimizing corrosion of the ignitor head by the burning gas.

8 Claims, 2 Drawing Sheets

PILOTLESS FLARE IGNITOR

BACKGROUND OF THE INVENTION

1. Field of the Invention

This invention relates to devices for igniting combustible waste gases and more particularly, to a pilotless flare ignitor which utilizes a timed spark for igniting waste gas issuing from a flare stack. In a preferred embodiment the pilotless flare ignitor is characterized by an ignitor housing including a horizontal ignitor head having an open end which extends through an opening provided in the flare stack. A pair of parallel electrodes are mounted in the ignitor head, the ends of which electrodes are angled to define a diagonal spark gap in which a timed spark is periodically or intermittently generated by means of a timer-controlled, step-up transformer wired to the electrodes. As the waste gas flows upwardly through the flare stack and into the open end of the ignitor head, the timer is operated in a preselected on-off sequence to energize the generator and the spark ignites the waste gas in the ignitor head and flare stack. After the spark is extinguished, the flaming gas is cleared from within the ignitor head and confined essentially to that segment of the flame stack located above the ignitor head, to minimize corrosion of the ignitor head by the burning gas.

Natural gas or methane is often found with deposits of petroleum. When the gas occurs in quantities which are too small for economical transportation to a point of use, the gas is considered waste gas and disposed of in the most convenient manner. For example, in oil drilling operations, natural gas frequently becomes mixed with the packing mud in the drill hole. The mud is passed through a mud-gas separator and the major portion of the mud re-circulated to the drill hole, while the gas is expelled through a vertical flare pipe. Whereas in earlier times the gas was simply vented into the atmosphere, current safety regulations generally require the waste gas, which typically contains entrained liquid hydrocarbons, to be burned or flared in order to prevent fire and explosion hazards.

2. Description of the Prior Art

Various arrangements have been devised for the ignition of combustible waste gases vented through vertical flare stacks. Originally, methods of igniting the waste gas included shooting flaming arrows, tracer bullets or signal-type flares through the gas emanating from the flare pipe. However, these practices were unreliable at best and often proved dangerous to humans or livestock in the area of the stack. Another method of igniting the gas included burning an open container of liquid fuel, such as diesel fuel, near the flare pipe outlet. However, the burning diesel fuel was often extinguished by wind or rain, and reignition of the fuel in the presence of accumulating gas was extremely hazardous. Still another method included igniting the gas by an electric spark using an automobile spark coil, electric fence charger or other type of transformer, but since the electrode elements in these applications were placed directly in the stream of the burning gas, they were quickly burned or corroded beyond further use. Additionally, the transformers were often damaged, either by the radiant heat of the gas flame or by the flame itself, as it was blown back toward the transformer by the wind.

Conventional waste gas flare ignitors typically utilize a pilot light or spark-generating electrode which is temporarily placed in the stream of the flowing gas to ignite the gas, and then retracted from the burning gas to prevent damage to the pilot light or electrode. Typical of these flare ignitors is the "Waste Gas Flare Ignitor" detailed in U.S. Pat. No. 4,431,402, dated Feb. 14, 1984, to Louis F. Hamilton. The flare ignitor is characterized by a movable pilot structure which burns a stored fuel for a selected period of time in order to ignite waste gas issuing from a horizontal flare pipe. The ignitor includes a heat shield, behind which the pilot structure is withdrawn after ignition of the gas, for protection from the heat of the burning gas. Another flare ignitor is the STACKKATCH (trademark) "Hot Rod", manufactured by the Stackmatch Flare Ignition Corporation of Plano, Texas. The flare ignitor is characterized by a pilot gas conduit or pipe which is hingedly and vertically mounted on the flare stack and terminated by a series of pilot openings located between a pair of circular plates provided on the upper end of the pipe. As the pilot gas is distributed upwardly through the pipe and ignited by an electronic pilot generator located inside the pipe adjacent to the pilot openings, the plates are positioned partially over the outlet of the flare stack and the issuing gas ignited, after which the flare ignitor is pivoted away from the stream of burning gas. Still another flare ignitor is manufactured by Flare Industries, Inc., of Austin, Tex. The flare ignitor is characterized by an electronic ignitor head which produces a spark for igniting the waste gas and is mounted on the upper end of a support rod pivotally and vertically mounted on the flare stack. The ignitor head is extended through an opening provided in a wind deflector mounted on the outlet of the flare stack for igniting the issuing waste gas, after which the support rod is pivoted on the flare stack to remove the ignitor head from the stream of burning gas.

An object of this invention is to provide a new and improved, non-pivotable and pilotless flare ignitor for igniting waste gas issuing from a flare stack.

Another object of this invention is to provide a pilotless flare ignitor which transiently produces a spark inside a housing for igniting waste gas issuing from the outlet of a vertical flare stack, wherein the flaming waste gas is essentially confined to that portion of the flare stack extending above the flare ignitor after the spark is extinguished, in order to prevent damage or corrosion of the flare ignitor by the flaming gas.

Still another object of this invention is to provide a non-pivoting, pilotless flare ignitor characterized by an ignitor housing having an open end which extends into a flare stack, within which housing is contained a pair of electrodes defining an angularly-oriented or diagonal spark gap, in which a spark is intermittently generated by means of a timer-controlled, step-up transformer wired to the electrodes, for periodically generating a spark of controlled duration in the spark gap in order to ignite the waste gas issuing from the flare stack. After the spark is extinguished, the flaming gas is cleared from the ignitor housing and confined to that portion of the flare stack extending above the housing to prevent excessive burning or corrosion of the flare ignitor by the flaming gas.

SUMMARY OF THE INVENTION

These and other objects of the invention are provided in a new and improved, non-pivoting pilotless flare ignitor for igniting waste gas issuing from a flare stack and clearing the ignited gas from the flare ignitor in order to prevent excessive burning or corrosion of the flare ignitor by the burning gas. In a preferred embodiment the flare ignitor is characterized by an ignitor housing, the open end of which extends through the wall of the flare stack into the stream of issuing gas. A pair of electrodes wired to a timer-controlled transformer are typically horizontally mounted in the housing and are accessed by a hinged cover, preferably having a bevelled edge at the open end of the ignitor housing. The ends of the electrodes define a 45-degree diagonal spark gap with respect to the horizontal, in which a spark of controlled duration is intermittently generated by the transformer to periodically ignite the gas in the housing and flare stack. After the spark between the electrodes is extinguished, the flaming waste gas is cleared from the housing and generally confined to the area of a flare stack located above the housing, thereby preventing excessive burning or corrosion of the in-place flare ignitor by the burning gas.

BRIEF DESCRIPTION OF THE DRAWING

The invention will be better understood by reference to the accompanying drawing, wherein.

DESCRIPTION OF THE PREFERRED EMBODIMENTS

Figure 1:
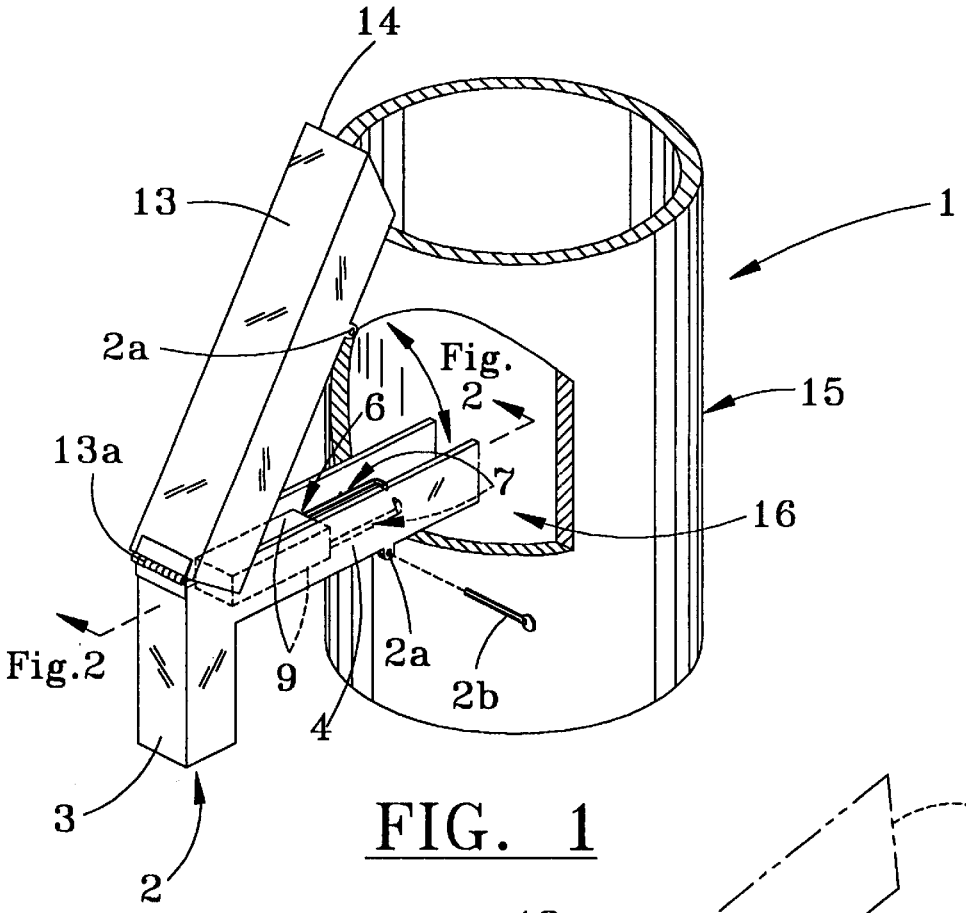
FIG. 1 is a perspective view of the ignitor housing element of the pilotless flare ignitor of this invention, extending horizontally through an opening provided in the wall of a vertical flare stack.
Figure 2:
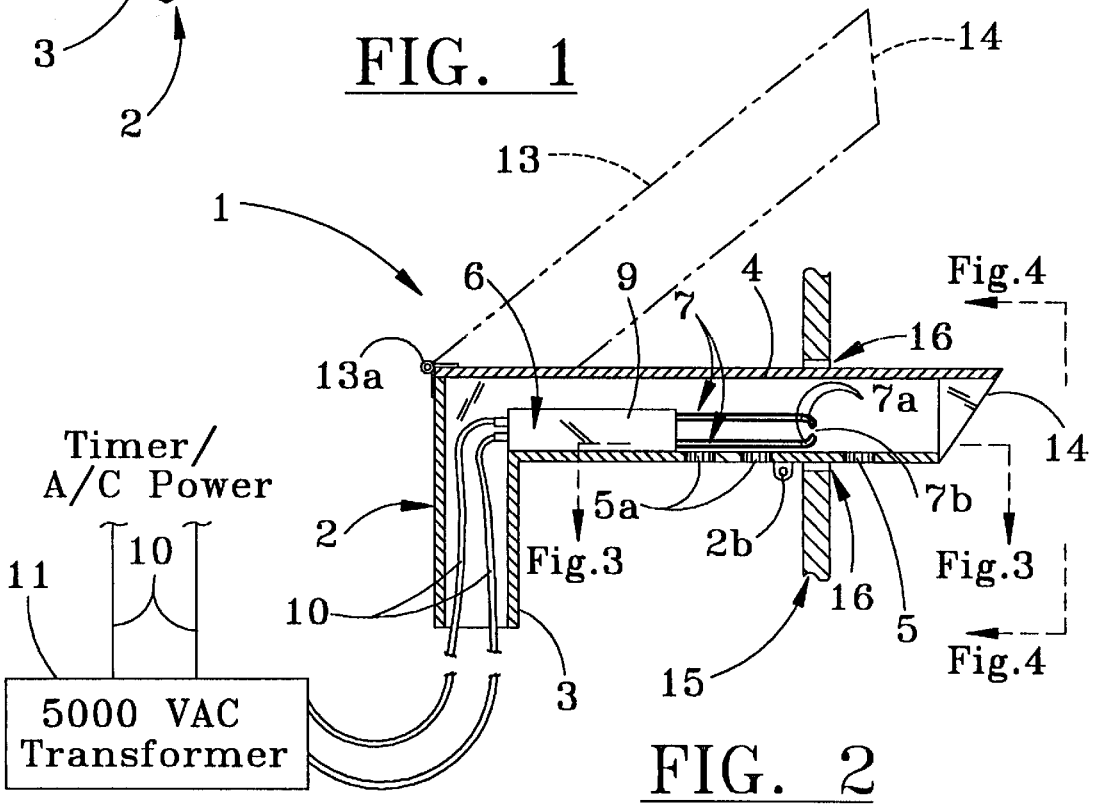
FIG. 2 is a sectional view, taken along section lines 2—2 in FIG. 1 of the pilotless flare ignitor, more particularly illustrating an electrode assembly provided in the ignitor housing and a preferred wiring scheme for the electrodes, transformer and timer elements of the flare ignitor.
Figure 3:
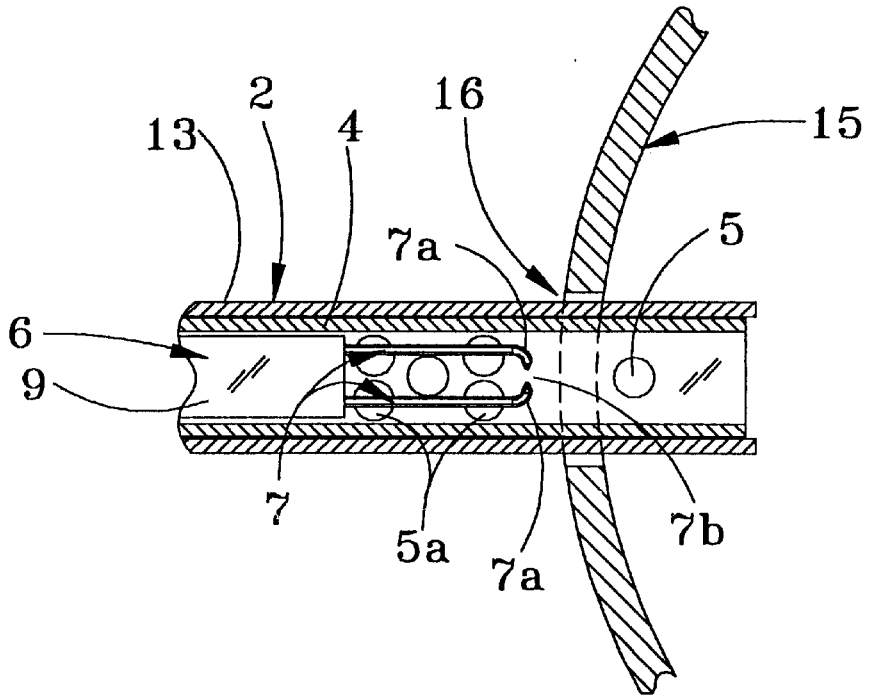
FIG. 3 is a bottom view, partially in section, of the burner end of the ignitor housing.
Figure 4:
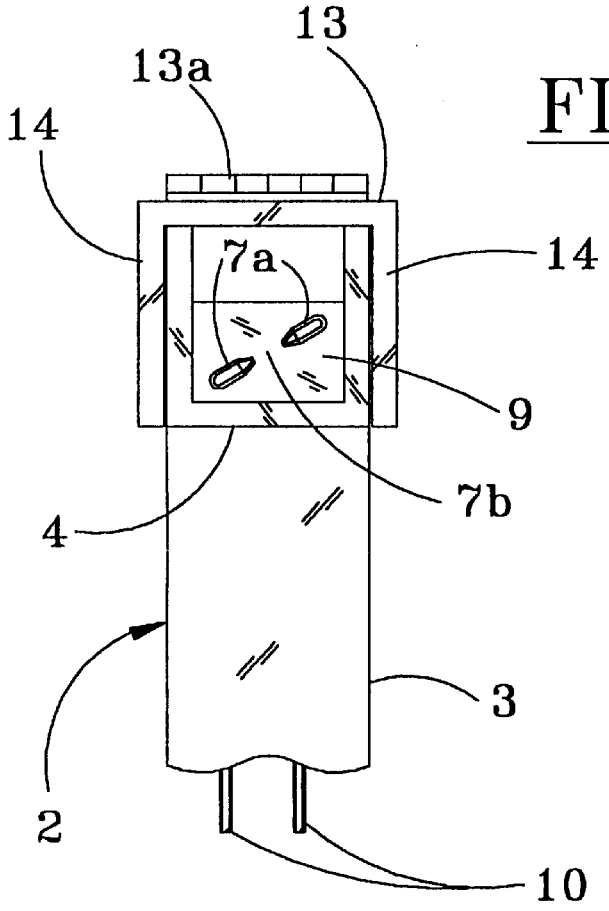
FIG. 4 is a front view of the burner end of the burner end of the ignitor housing of the pilotless flare ignitor of this invention.

Referring initially to FIGS. 1–4 of the drawing, in a preferred embodiment the pilotless flare ignitor of this invention is generally illustrated by reference numeral 1. The pilotless flare ignitor 1 includes a substantially L-shaped ignitor housing 2, typically constructed from steel or aluminum square tubing and characterized by an open-ended, horizontal ignitor head 4, having a substantially U-shaped cross-sectional configuration, as illustrated in FIG. 4, and the open burner end of which extends through an ignitor opening 16 provided in the wall of a flare stack 15, as illustrated in FIGS. 1 and 3, adjacent to the outlet thereof. As illustrated in FIG. 2, an electrode assembly 6 includes a pair of parallel electrodes 7, mounted horizontally in the ignitor head 4 and having facing electrode ends 7*a*, that define a diagonally-oriented spark gap 76, as illustrated in FIG. 4, for igniting waste gas issuing upwardly through the flare stack 15, as hereinafter further described. The ignitor housing 2 further includes a wiring conduit 3, which extends downwardly from the rear end of the ignitor head 4, through which wiring conduit 3 wiring 10 passes, connecting the electrodes 7 to a transformer 11 for generating a spark between the electrodes 7, as illustrated in FIG. 2 and hereinafter further described. An electrode access cover 13, preferably having a cover bevel 14 and lip 8 on the burner end, is typically hingedly mounted on the ignitor head 4 at the rear edge thereof by means of a hinge 13*a*, to facilitate accessing the electrode assembly 6 in the ignitor head 4, as illustrated in FIGS. 1 and 2. Pin openings 2*a* in the ignitor head 4 and the electrode access cover 13 coincide to receive a housing pin 2*b* and secure the electrode access cover 13 on the ignitor head 4. As illustrated in FIGS. 2 and 3, multiple gas openings 5 and air openings 5*a* are typically provided in the bottom surface of the ignitor head 4 in a selected pattern, to facilitate entry of the upwardly-flowing waste gas and air, respectively, into the ignitor head 4 for contact with a spark intermittently generated between the diagonally-oriented electrode ends 7*a* of the electrodes 7.

Referring again to FIGS. 2 and 4 of the drawing, the i electrode assembly 6 preferably includes an insulator 9, through which the electrodes 7 extend horizontally in substantially facing relationship, as illustrated in FIG. 4, defining a spark gap 7*b* diagonally disposed at about a 45-degree angle with respect to the horizontal and vertical, between the ends thereof, as illustrated in FIG. 4. The ceramic insulator 9 is removably mounted in the ignitor housing 2 and serves to insulate the electrodes 7. Wiring 10 is connected to the respective electrodes and extends down the wiring conduit 3 to a 5000-volt, step-up AC transformer 11, which periodically generates a spark between the ends of the electrodes 7, the duration of each spark being determined by a timer 12, which is typically wired to the transformer 11.

In operation, the waste gas flows upwardly through the flare stack 15 and enters the ignitor head 4 of the ignitor housing 2 through the gas opening 5 and the open, extending end of the ignitor head 4. Air also flows into the ignitor head 4 through the air openings 5*a* and the cover bevel 14 facilitates efficient mixing of the air and waste gas as the waste gas stream strikes the projecting lip 8 at the top of the cover bevel 14. Operation of the timer 12 causes energizing of the transformer 11, typically for a period of approximately five seconds, and the transformer 11 generates a spark of the same duration between the diagonal electrode ends 7*a* of the electrodes 7 in the ignitor head 4. The gas contained in the ignitor head 4 is immediately ignited and further ignites the waste gas flowing upwardly in the flare stack 15. When the spark between the electrodes 7 is extinguished by operation of the timer 12, the gas entering the ignitor head 4 is no longer ignited, primarily because of the diagonal positioning of the spark gap 7*b* and the shielding effect of the overhanging lip 8 of the electrode access cover 13 at the top of the cover bevel 14. Accordingly, the burning waste gas is substantially confined to the area of the flare stack 15 which is located above the ignitor head 4, thus reducing the heat applied to the ignitor head 4, lengthening the life of the electrodes 7 and eliminating the necessity for pivoting the ignitor head 4 from the flare stack 15.

It will be appreciated by those skilled in the art that the diagonal arrangement of the electrode ends 7*a* of the electrodes 7 in the ignitor head 4, in combination with the cover bevel 14 and the timing of the generated spark, promotes self-clearing of the ignitor head 4 of burning waste gas after ignition of the gas, thereby further preventing excessive burning or corrosion of the electrodes 7, ignitor head 4 or other components of the flare ignitor 1. Furthermore, replacement of the electrodes 7 or other components of the ignitor head 4 is easily effected by removing the housing pin 26 from the pin openings 2*a* and pivoting the electrode access cover 13 from the closed position illustrated in FIG. 4 to the open position illustrated in FIGS. 1 and 2, to remove the insulator 9 and electrodes 7. It will be further appreciated that the ignitor housing 2 prevents wind, rain or other influences from hindering ignition of the waste gas in the flare stack 15, since the ignitor head 4 remains in the flare stack 15.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. A pilotless flare ignitor for igniting waste gas issuing from a flare stack, said ignitor comprising an ignitor housing having an open end for extending into the flare stack; at least one gas opening provided in said ignitor housing adjacent to said open end of said ignitor housing for positioning in the flare stack and facilitating flow of waste gas from the flare stack into said ignitor housing; at least one air opening provided in said ignitor housing for positioning outside the flare stack and facilitating flow of air into said ignitor housing; and electrodes provided in said ignitor housing for producing a spark having a selected duration in said ignitor housing and igniting the waste gas in said ignitor housing and the flare stack, said electrodes disposed in a plane oriented in angular relationship with respect to a horizontal plane.

2. The pilotless flare ignitor of claim 1 comprising means electrically connected to said electrodes for controlling the duration of said spark.

3. The pilotless flare ignitor of claim 1 comprising means carried by said ignitor housing for providing access to said electrodes.

4. The pilotless flare ignitor of claim 1 comprising means electrically connected to said electrodes for controlling the duration of said spark and means carried by said ignitor housing for providing access to said electrodes.

5. A pilotless flare ignitor for igniting waste gas issuing from a vertical flare stack, comprising an ignitor housing having an open end for extending into the flare stack; a pair of electrodes mounted in said ignitor housing, said electrodes disposed in a plane positioned in angular relationship with respect to the horizontal; a transformer electrically connected to said electrodes for generating a spark between said electrodes, whereby said spark ignites waste gas in said ignitor housing and the flare stack responsive to operation of said transformer; a timer electrically connected to said transformer for controlling the duration of said spark by operating said transformer for a selected period of time; at least one gas opening provided in said ignitor housing adjacent to said open end of said ignitor housing for positioning in the flare stack and facilitating flow of waste gas from the flare stack into said ignitor housing; and at least one air opening provided in said ignitor housing for positioning outside the flare stack and facilitating flow of air into said ignitor housing.

6. The pilotless flare ignitor of claim 5 wherein said at least one air opening comprises a plurality of air openings provided in said ignitor housing.

7. The pilotless flare ignitor of claim 6 comprising an access cover hingedly carried by said ignitor housing for providing access to said electrodes and a bevel provided on said cover means at said open end of said ignitor housing and above said at least one gas opening, whereby gas enters said ignitor housing from the flare stack, strikes said bevel and mixes with the air in said ignitor housing.

8. A pilotless flare ignitor for igniting waste gas issuing from a vertical flare stack, comprising an ignitor housing including a substantially horizontal ignitor head having a bottom surface and an open end for extending into the flare stack; a plurality of air openings provided in said bottom surface of said ignitor head in a selected pattern for positioning outside the flare stack and facilitating air flow into said ignitor head; at least one gas opening provided in said bottom surface of said ignitor head for positioning in the flare stack and receiving waste gas in said ignitor head; a pair of electrodes mounted substantially horizontally in said ignitor head and having extending ends positioned in a plane disposed at substantially a 45-degree angle with respect to the horizontal, said extending ends defining a spark gap; a step-up transformer electrically connected to said electrodes for generating a spark in said spark gap, whereby said spark ignites waste gas in said ignitor head and the flare stack, responsive to operation of said transformer; a timer electrically connected to said transformer for controlling the duration of said spark by operating said transformer for a selected period of time; an electrode access cover hingedly carried by said ignitor head for providing access to said electrodes and a bevel provided on said access cover at said open end of said ignitor housing and above said at least one gas opening, whereby waste gas enters said ignitor housing from the flare stack, strikes said bevel and mixes with the air in said ignitor housing.

* * * * *